US009687703B2

(12) United States Patent
Li

(10) Patent No.: US 9,687,703 B2
(45) **Date of Patent: *Jun. 27, 2017**

(54) METHOD FOR MANUFACTURING A HIGH-STRENGTH GOLF IRON HEAD WITH A THIN STRIKING FACEPLATE

(71) Applicant: FUSHENG PRECISION CO., LTD., Taipei (TW)

(72) Inventor: Chien-Liang Li, Taipei (TW)

(73) Assignee: Fusheng Precision Co., Ltd., Taipei (TW)

( * ) Notice: Subject to any disclaimer, the term of this patent is extended or adjusted under 35 U.S.C. 154(b) by 227 days.

This patent is subject to a terminal disclaimer.

(21) Appl. No.: 14/452,584

(22) Filed: Aug. 6, 2014

(65) Prior Publication Data

US 2015/0090418 A1 Apr. 2, 2015

(30) Foreign Application Priority Data

Sep. 30, 2013 (TW) ..... 102135375 A

(51) Int. Cl.

| | |
|---|---|
| ***B22C 9/04*** | (2006.01) |
| ***B22D 13/06*** | (2006.01) |
| ***B22D 13/10*** | (2006.01) |
| ***A63B 53/04*** | (2015.01) |

(52) U.S. Cl.

CPC ..... *A63B 53/047* (2013.01); *B22C 9/043* (2013.01); *B22D 13/06* (2013.01); *B22D 13/101* (2013.01)

(58) Field of Classification Search

CPC ..... B22C 9/04; B22C 9/043; B22D 13/04; B22D 13/101; B22D 13/107; B22D 13/108; B22D 13/06

USPC ..... 164/35, 61, 114

See application file for complete search history.

(56) References Cited

U.S. PATENT DOCUMENTS

| | | | | |
|---|---|---|---|---|
| 6,386,265 | B1 * | 5/2002 | Usui | A61C 13/20 164/114 |
| 6,875,124 | B2 | 4/2005 | Gilbert et al. | |
| 7,513,296 | B1 * | 4/2009 | Yu et al. | B22C 9/04 164/35 |

(Continued)

FOREIGN PATENT DOCUMENTS

| | | | |
|---|---|---|---|
| JP | H06170512 | A | 6/1994 |
| JP | H09322953 | A | 12/1997 |

(Continued)

*Primary Examiner* — Kevin P Kerns

(74) *Attorney, Agent, or Firm* — Alan D. Kamrath; Kamrath IP Lawfirm, P.A.

(57) ABSTRACT

A method for manufacturing a high-strength golf iron head with a thin striking faceplate includes placing a shell mold onto a rotary table. At least one metal ingot is placed into a crucible portion of the shell mold and melts in a vacuum environment. The rotary table rotates to cause the molten metal to flow into a cavity portion of the shell mold. The rotating shaft is slowly stopped, and the shell mold is removed after pouring. The shell mold is destroyed after the molten metal cools and solidifies, obtaining a casting. A cast product portion is separated from the casting to obtain at least one golf iron head subsequently treated with heat treatment to provide a striking faceplate of the golf iron head with a tensile strength of 280-340 ksi, an elongation of 4%-20%, and a minimum thickness of 1.4-1.8 mm excluding a groove depth of the striking faceplate.

12 Claims, 7 Drawing Sheets

(56) References Cited

U.S. PATENT DOCUMENTS

| | | | | |
|---|---|---|---|---|
| 8,167,023 | B2 | 5/2012 | Renkel | |
| 2003/0042001 | A1* | 3/2003 | Ray et al. | B22C 3/00 164/529 |
| 2011/0094705 | A1 | 4/2011 | Kelly et al. | |
| 2015/0090419 | A1* | 4/2015 | Li | A63B 53/047 164/35 |

FOREIGN PATENT DOCUMENTS

| | | | |
|---|---|---|---|
| JP | 2000033133 | A | 2/2000 |
| JP | 2001190720 | A | 7/2001 |
| JP | 2002177421 | A | 6/2002 |
| JP | 2002301553 | A | 10/2002 |
| JP | 2004358223 | A | 12/2004 |
| JP | 2005279093 | A | 10/2005 |
| JP | 2009125811 | A | 6/2009 |
| TW | 330866 | | 5/1998 |
| TW | 201215467 | A1 | 4/2012 |

* cited by examiner

METHOD FOR MANUFACTURING A HIGH-STRENGTH GOLF IRON HEAD WITH A THIN STRIKING FACEPLATE

BACKGROUND OF THE INVENTION

1. Field of the Invention

The present invention relates to a method for manufacturing a golf club head and, more particularly, to a method for manufacturing an integrally formed high-strength golf iron head with a thin striking faceplate.

2. Description of the Related Art

Golf club heads includes woods, irons, and putters. Early woods and irons are generally made of stainless steel or carbon steel to increase the performance of the golf club heads. New steel-type cast materials have been continuously developed in recent years and have been used to manufacture golf club heads. For example, steel type alloys containing cobalt, molybdenum, or titanium generally has a high strength (the tensile strength is higher than 250 ksi) suitable for manufacturing golf iron heads.

Currently, golf iron heads are produced in the atmosphere by using a high frequency induction furnace to rapidly melt the cast materials. Next, the slag and gases in the molten metal are removed by slagging and refinery steps. Static gravity pouring is then carried out to obtain a golf iron head.

However, the cast materials for golf iron heads often include active metals (such as manganese, aluminum, silicon, cobalt, molybdenum, and titanium) that are apt to react with oxygen in the air. Thus, rigorous oxidation easily occurs during the procedures of smelting of the cast materials, increasing difficulties in melting and easily causing oxidative fire cracks due to reaction with air during pouring. As a result, appearance defects, such as sesame dot defects and black bean defects, are apt to be formed on the cast products of the golf iron heads. In worse situations, the reactive gas forms a large number of slag holes or blowholes in the cast products of the golf iron heads and, thus, adversely affects the tensile strength of the golf iron heads, limiting the thickness of the striking faceplates of the golf iron heads.

Namely, to assure that the striking faceplate of a golf iron head can meet the tensile strength standard for withstanding cannon shots of predetermined strength and times without damage, the thickness of the striking faceplate of a current integrally formed golf iron head is still too thick. Table 1 shows the tensile strengths and minimum thicknesses of striking faceplates of golf iron heads made of different materials by gravity pouring in the atmosphere, wherein the "minimum thickness" is defined as the minimum thickness of a striking faceplate having a strength capable of withstanding 3000 cannon shots at a speed of 50 m/s without damage (excluding the groove depth).

TABLE 1

| striking faceplate material | tensile strength (ksi) | minimum thickness (mm) | striking faceplate material | tensile strength (ksi) | minimum thickness (mm) |
|---|---|---|---|---|---|
| NANO 5 | 58 | 3.20 | 450 | 170 | 2.45 |
| 303 | 77 | 3.20 | 450 | 180 | 2.35 |
| 304 | 77 | 3.20 | HYPER17-4 | 200 | 2.3 |
| 8620 | 85 | 3.20 | AM355 | 210 | 2.3 |
| MS225 | 98 | 2.85 | ES230 | 230 | 2.20 |
| M-9 | 98 | 2.90 | 4130 | 230 | 2.15 |
| 431 | 100 | 2.85 | 4130 | 230 | 2.15 |
| ST-23 | 102 | 3.20 | ES235 | 235 | 2.20 |

TABLE 1-continued

| striking faceplate material | tensile strength (ksi) | minimum thickness (mm) | striking faceplate material | tensile strength (ksi) | minimum thickness (mm) |
|---|---|---|---|---|---|
| 431 | 110 | 2.85 | SUP 10 | 236 | 2.20 |
| LD-745 | 120 | 2.8 | 15-7 PH | 240 | 2.20 |
| 2205 | 125 | 2.70 | 455 | 250 | 2.10 |
| 17-4PH | 140 | 2.7 | 465 + (275) | 270 | 2.05 |
| ST-22 | 149 | 2.75 | 475 | 280 | 2.00 |

As can be seen from Table 1, to achieve the same cannon shot conditions, the tensile strength and the minimum thickness of each striking faceplate material are highly related. Namely, the minimum thickness can be smaller if the tensile strength of the striking faceplate is higher. Furthermore, given the above cannon shot conditions, the average minimum thickness (excluding the groove depth) of the striking faceplate of a current integrally-formed golf iron head is about 2.59 mm. For a striking faceplate having a higher strength (above 250 ksi), the minimum thickness (excluding the groove depth) has to be more than 2.0 mm. Thus, there is a bottleneck in reducing the overall weight of current golf iron heads.

Furthermore, rigorous oxidation also reduces the flowability of the molten metal in the shell mold, leading to a reduced yield of the cast products of golf iron heads due to insufficient pouring or resulting in gaps in the cast products of the golf iron heads due to cold shut. The tensile strength of the cast products of the golf iron heads is also adversely affected.

Thus, improvement to conventional methods for manufacturing golf iron heads is desired.

SUMMARY OF THE INVENTION

An objective of an embodiment of the present invention is to provide a method for manufacturing a high-strength golf iron head with a thin striking faceplate to reduce the chemical reaction of the cast material with air during smelting, increasing the tensile strength of the cast product to allow thinning of the striking faceplate of the golf iron head.

Another objective of the embodiment of the present invention is to provide a method for manufacturing a high-strength golf iron head with a thin striking faceplate to increase the yield and quality of the cast products.

The present invention fulfills the above objectives by providing a method for manufacturing a high-strength golf iron head with a thin striking faceplate. The method includes placing a shell mold onto a rotary table. The shell mold includes a crucible portion and a cavity portion in communication with the crucible portion. The rotary table is coupled to a rotating shaft rotatable about a rotating axis. At least one metal ingot is placed into the crucible portion of the shell mold and is heated to melt into molten metal in a vacuum environment. The rotating shaft is driven to rotate the rotary table, causing the molten metal to flow into the cavity portion of the shell mold. The rotating shaft is slowly stopped, and the shell mold is removed after pouring. The shell mold is destroyed after the molten metal cools and solidifies, obtaining a casting having a cast product portion. The cast product portion is separated from the casting to obtain at least one golf iron head. Heat treatment is conducted on the at least one golf iron head to provide a striking faceplate of the at least one golf iron head with a tensile strength of 280-340 ksi, an elongation of 4%-20%, and a minimum thickness of 1.4-1.8 mm excluding a groove depth of the striking faceplate.

In an example, the at least one metal ingot includes a metal ingot of a high-strength steel alloy, and the metal ingot has a composition identical to a composition of a high-strength golf iron head to be produced.

In another example, the at least one metal ingot includes a plurality of metal ingots, and a composition of the molten metal of the plurality of metal ingots is identical to a composition of a high-strength golf iron head to be produced.

The method can further include forming the shell mold. Forming the shell mold includes preparing a wax blank including a crucible blank and a casting blank. The crucible blank includes a first connecting portion on an outer periphery of the crucible blank. The casting blank includes a second connecting portion. The first connecting portion and the second connecting portion are integrally connected to each other. An enveloping layer is formed on an outer surface of the wax blank. The wax blank and the enveloping layer are heated to melt the wax out. The dewaxed enveloping layer is sintered at a high temperature to form the shell mold including the crucible portion and the cavity portion integral with the crucible portion.

The shell mold can include a surface layer of a fire-resistant material including zirconium silicate, yttrium oxide, stabilized zirconium oxide, or aluminum oxide.

In an example, the shell mold includes a back layer of a material including a mullite compound containing 45-60 wt % of aluminum oxide and 55-40 wt % of silicon oxide.

In another example, the shell mold includes a back layer of a material including a silicon oxide compound containing more than 95% of silicon oxide.

Thus, the method for manufacturing a high-strength golf iron head with a thin striking faceplate according to the present invention can reduce the chemical reaction of the cast material with air during smelting, increasing the tensile strength of the cast product to allow thinning of the striking faceplate of the golf iron head while increasing the yield and quality of the cast products.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
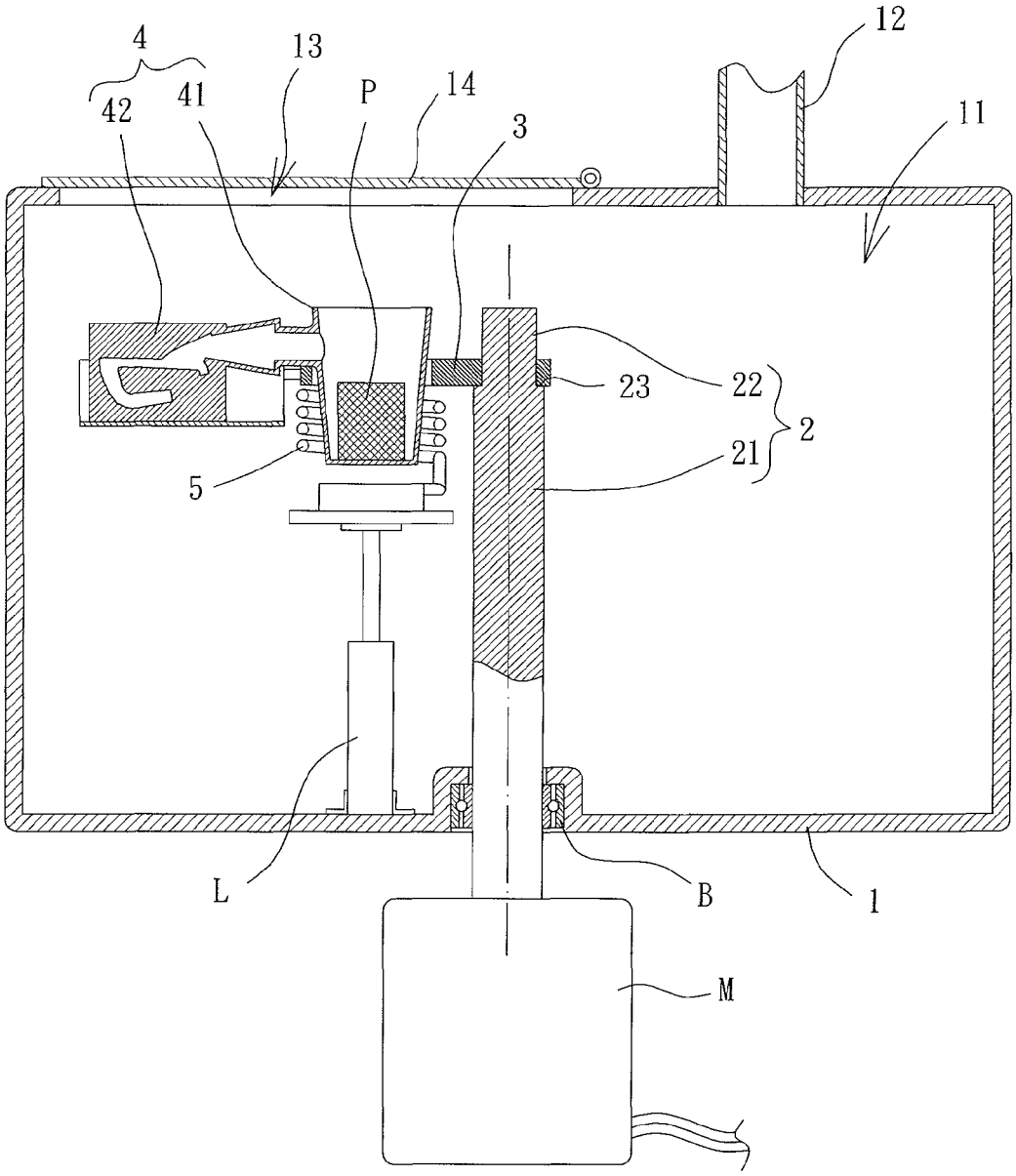
FIG. 1 is a diagrammatic cross sectional view of a vacuum centrifugal casting device capable of carrying out a method for manufacturing a high-strength golf iron head with a thin striking faceplate according to the present invention.

FIG. 1 is a diagrammatic cross sectional view of a vacuum centrifugal casting device capable of carrying out a method for manufacturing a high-strength golf iron head with a thin striking faceplate according to the present invention. The vacuum centrifugal casting device includes a vacuum furnace 1, a rotating shaft 2, a rotary table 3, a shell mold 4, and a heater 5. The rotating shaft 2, the rotary table 3, the shell mold 4, and the heater 5 are mounted in the vacuum furnace 1. The rotary table 3 is connected to the rotating shaft 2 to rotate synchronously with the rotating shaft 2. The shell mold 4 is positioned on the rotary table 3. The heater 5 is used to heat the shell mold 4.

Specifically, the vacuum furnace 1 includes a chamber 11. A gas guiding tube 12 is mounted to the vacuum furnace 1 and intercommunicates with the chamber 11. A vacuum controller (not shown) can be operated to control the vacuum degree in the chamber 11 by drawing gas out of the chamber 11 via the gas guiding tube 12 according to set values. Furthermore, the vacuum furnace 1 can include an opening 13 permitting a user to place an object into the chamber 11 or retrieve the object out of the chamber 11, and a cover 14 can be provided to control opening and closing of the opening 13.

Figure 2:
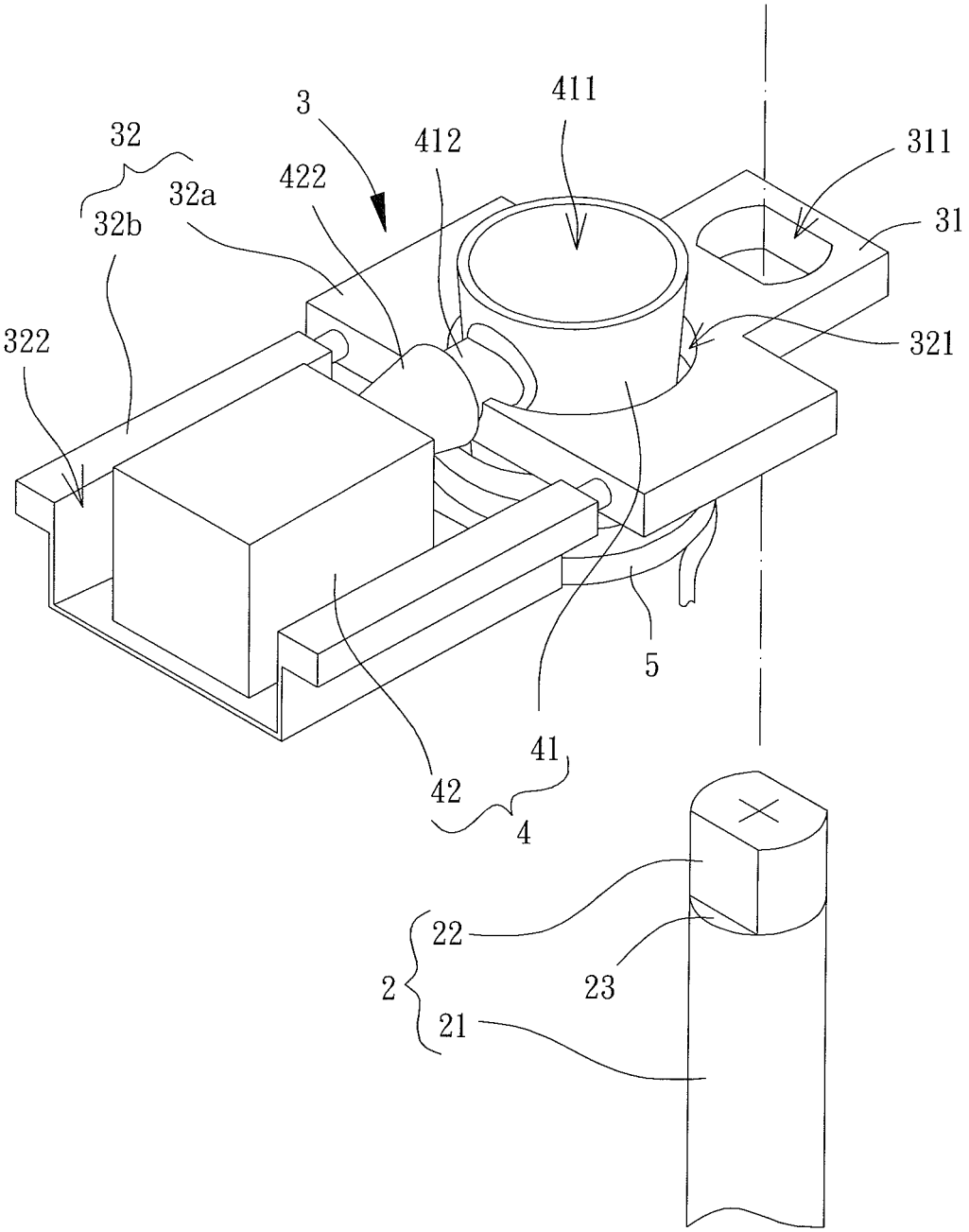
FIG. 2 is an exploded, perspective view of a portion of the vacuum centrifugal casting device of FIG. 1.

With reference to FIGS. 1 and 2, the rotating shaft 2 is mounted in the chamber 11 of the vacuum furnace 1 and is rotatable about a rotating axis. In this embodiment, the rotating shaft 2 is coupled to an output end of a motor M and can be driven by the motor M to rotate. The motor M can be mounted outside of the vacuum furnace 1, and an end of the rotating shaft 2 extends outside of the vacuum furnace 1 and is connected to the motor M. The rotating shaft 2 can be received in a bearing B fixed to the vacuum furnace 1, increasing rotating stability of the rotating shaft 2 and preventing wobbling of the rotating shaft 2 during rotation.

Furthermore, a portion of the rotating shaft 2 in the chamber 11 includes a body 21 and a stop portion 22. Cross sections of the body 21 perpendicular to the rotating axis are different from cross sections of the stop portion 22 perpendicular to the rotating axis, forming an abutment portion 23 at an intersection between the body 21 and the stop portion 22. The rotary table 3 is coupled to the stop portion 22 and abuts the abutment portion 23 such that the rotary table 3 synchronously rotates with the rotating shaft 2. In this embodiment, the cross sections of the body 21 perpendicular to the rotating axis are circular. The stop portion 22 is located on an end of the rotating shaft 2, and the cross sections of the stop portion 22 perpendicular to the rotating axis are non-circular, allowing the rotary table 3 to couple with the stop portion 22 and to abut the abutment portion 23.

Figure 3:
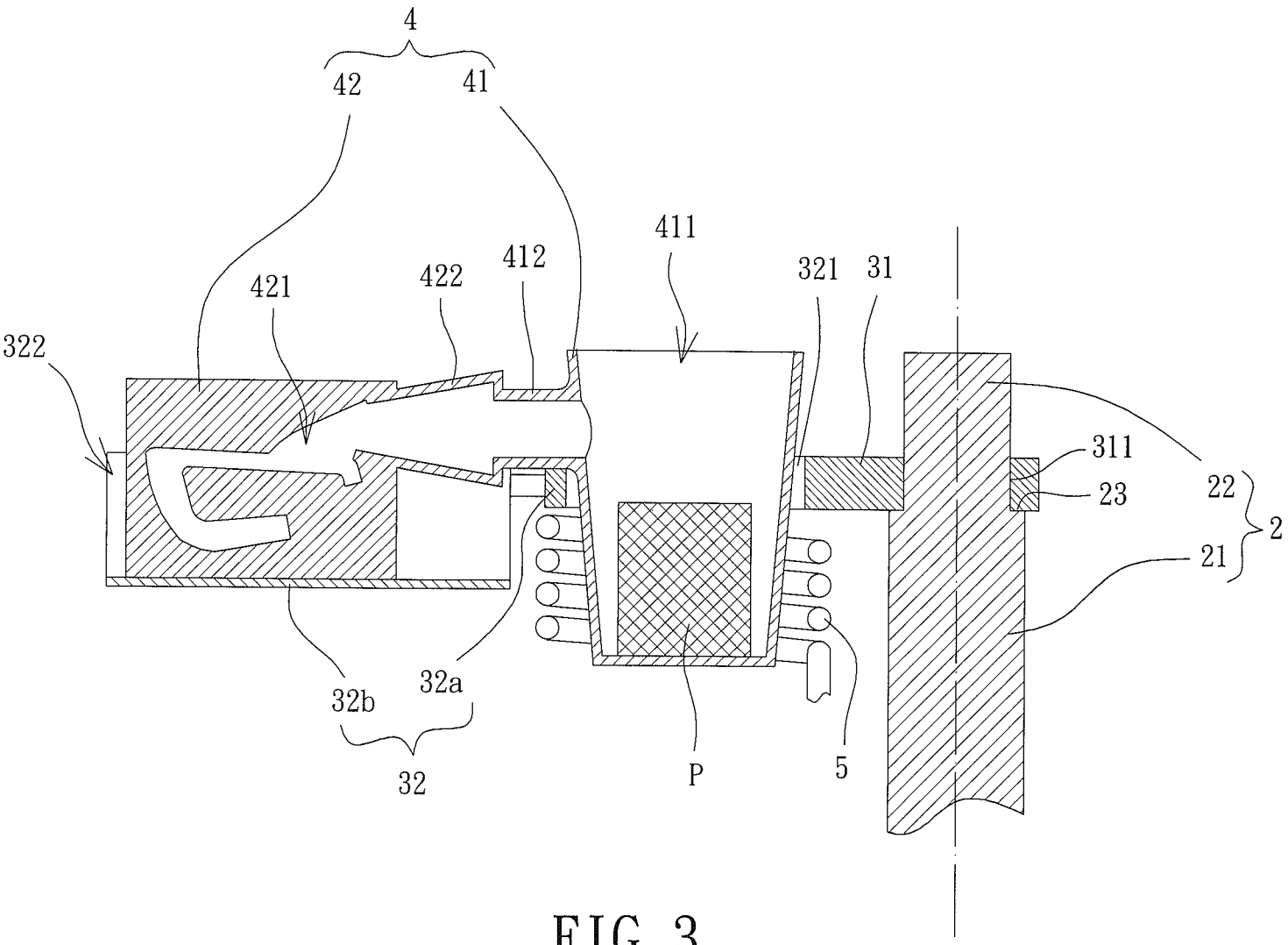
FIG. 3 is a cross sectional view of the portion of the vacuum centrifugal casting device of FIG. 2, illustrating a step of the method according to the present invention.

With reference to FIGS. 2 and 3, the rotary table 3 is a carrier on which the shell mold 4 is placed and positioned. The rotary table 3 includes a shaft coupling portion 31 and a positioning portion 32. In this embodiment, the shaft coupling portion 31 includes a through-hole 311 having cross sections corresponding to the cross sections of the stop portion 22 of the rotating shaft 2. Thus, the through-hole 311 of the shaft coupling portion 31 of the rotary table 3 receives the stop portion 22 of the rotating shaft 2 for coupling purposes. The positioning portion 32 of the rotary table 3 includes a crucible positioning portion 32*a* and a cavity positioning portion 32*b*. The crucible positioning portion 32*a* is located between the shaft coupling portion 31 and the cavity positioning portion 32*b*. Furthermore, the shaft coupling portion 31, the crucible positioning portion 32*a*, and the cavity positioning portion 32*b* are arranged in a radial direction perpendicular to the rotating axis. Furthermore, the crucible positioning portion 32*a* includes a receiving hole 321 for receiving a portion of the shell mold 4. The cavity positioning portion 32*b* includes a compartment 322 receiving another portion of the shell mold 4.

With reference to FIGS. 2 and 3, the shell mold 4 includes a crucible portion 41 and a cavity portion 42 in communication with the crucible portion 41. The crucible portion 41 of the shell mold 4 can be positioned in the crucible positioning portion 32*a* of the rotary table 3. The cavity portion 42 of the shell mold 4 can be positioned in the cavity positioning portion 32*b* of the rotary table 3. The crucible portion 41 of the shell mold 4 is located between the cavity portion 42 of the shell mold 4 and the shaft coupling portion 31 of the rotary table 3.

The crucible portion 41 is substantially cup-shaped and defines a receiving space 411 adapted for receiving metal ingots to be heated to melt. A first connecting tube 412 is provided on an outer periphery of the crucible portion 41 and is in communication with the receiving space 411. The cavity portion 42 is used to form a golf iron head. However, the outline of the cavity portion 42 is not limited. The cavity portion 42 includes at least one cavity 421 having a shape corresponding to a shape of the golf iron head to be cast. The cavity portion 42 further includes a second connecting tube 422 in communication with the at least one cavity 421. The crucible portion 41 and the cavity portion 42 are connected to each other by the first connecting tube 412 and the second connecting tube 422. Thus, the receiving space 411 is in communication with the at least one cavity 421.

Figure 4:
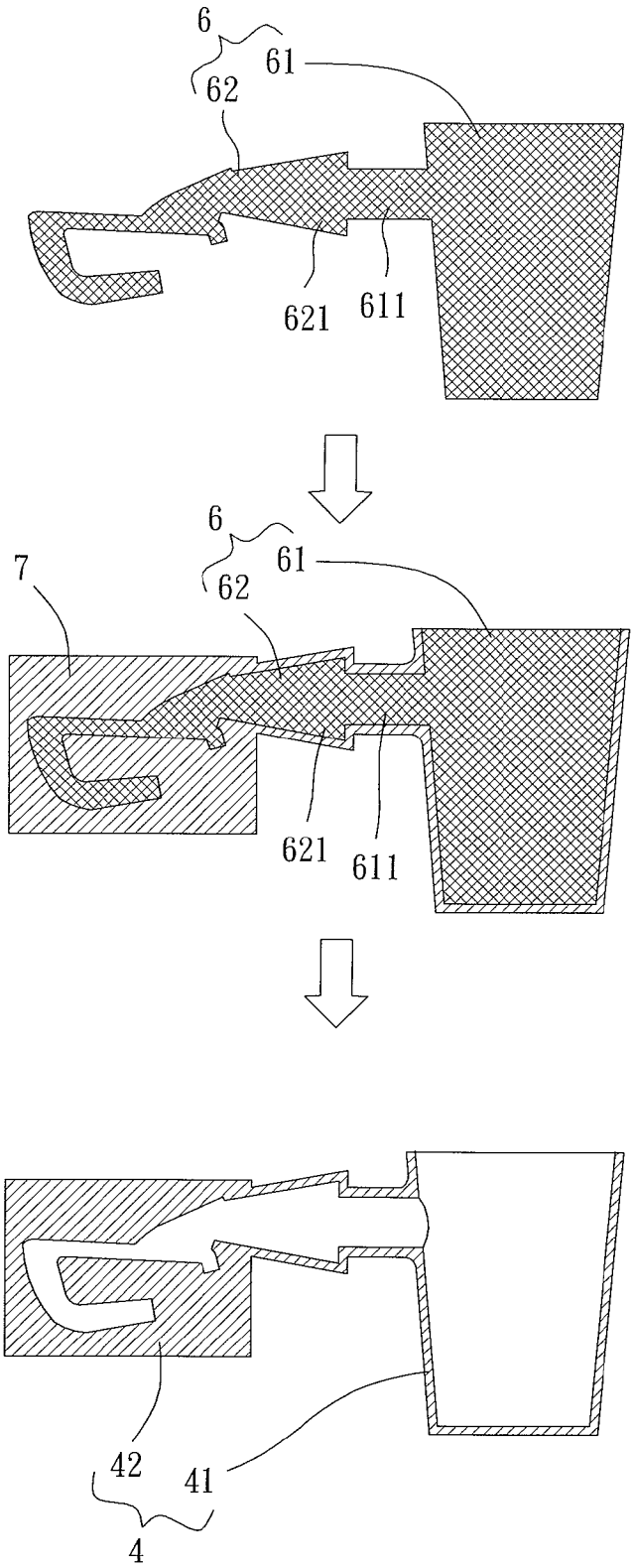
FIG. 4 shows procedures for forming a shell mold of the vacuum centrifugal casting device of FIG. 1.

With reference to FIG. 4, in this embodiment, the crucible portion 41 and the cavity portion 42 of the shell mold 4 are integrally connected to each other. Formation of the shell mold 4 includes preparing a wax blank 6 including a crucible blank 61 and a casting blank 62. The crucible blank 61 includes a first connecting portion 611 on an outer periphery of the crucible blank 61. The casting blank 62 includes a second connecting portion 621. The crucible blank 61 and the casting blank 62 are integrally connected to each other by the first connecting portion 611 and the second connecting portion 621. Next, an enveloping layer 7 is formed on an outer surface of the wax blank 6 by dipping, coating, and/or clogging. Then, the wax blank 6 and the enveloping layer 7 are heated to melt the wax out. As an example, the wax blank 6 and the enveloping layer 7 can be heated in a steam autoclave to melt the wax blank 6, and the molten wax flows out of the enveloping layer 7. The dewaxed enveloping layer 7 is sintered at a high temperature to form the shell mold 4 including the crucible portion 41 and the cavity portion 42 integral with the crucible portion 41. A fire-resistant material, such as zirconium silicate, yttrium oxide, stabilized zirconium oxide, or aluminum oxide, can be used as the material for a surface layer of the shell mold 4. A mullite ($3Al_2O_3$-$2SiO_2$) compound or silicon oxide can be used as a fire-resistant material for a back layer of the shell mold 4. In a case that the back layer uses a mullite compound, the mullite compound preferably contains 45-60 wt % of aluminum oxide and 55-40 wt % of silicon oxide. In another case that the back layer uses a silicon oxide compound, the silicon oxide compound preferably contains more than 95% of silicon oxide.

With reference to FIGS. 1 and 3, the heater 5 is mounted in the chamber 11 of the vacuum furnace 1 to heat the crucible portion 41 of the shell mold 4. In this embodiment, the heater 5 can be a high frequency coil and can be moved in the chamber 11 by using a lift controller L. If the crucible portion 41 of the shell mold 4 is to be heated, the heater 5 is moved upward to a preset location surrounding the crucible portion 41 and is activated to heat the crucible portion 41. After heating, the heater 5 is moved downward by the lift controller L to a position not surrounding the crucible portion 41, avoiding interference with rotational movement of the shell mold 4 following the rotation of the rotary table 3 and the rotating shaft 2.

In view of the above, the method for manufacturing a high-strength golf iron head with a thin striking faceplate according to the present invention can be implemented and includes the following steps.

With reference to FIGS. 1-3, a shell mold 4 is placed onto a rotary table 3 connected to a rotating shaft 2 rotatable about a rotating axis. Specifically, the rotary table 3 is mounted in a vacuum furnace 1 to control the vacuum degree of the space receiving the shell mold 4. Furthermore, the shell mold 4 includes a crucible portion 41 and a cavity portion 42 in communication with the crucible portion 41. The crucible portion 41 of the shell mold 4 extends through the receiving hole 321 of the rotary table 3, and the first connecting tube 412 of the crucible portion 41 abuts the rotary table 3. The cavity portion 42 of the shell mold 4 is received in the compartment 322 of the rotary table 3 such that the shell mold 4 is reliably positioned in a predetermined location on the rotary table 3. At least one metal ingot P is placed into the crucible portion 41 of the shell mold 4. In a case that the at least one metal ingot includes only one metal ingot P, the metal ingot P is a high-strength steel alloy and has a composition identical to a composition of a high-strength golf iron head to be produced. In another case that the at least one metal ingot includes a plurality of metal ingots P, a composition of the molten metal of the metal ingots P is identical to a composition of a high-strength golf iron head to be produced.

Figure 5:
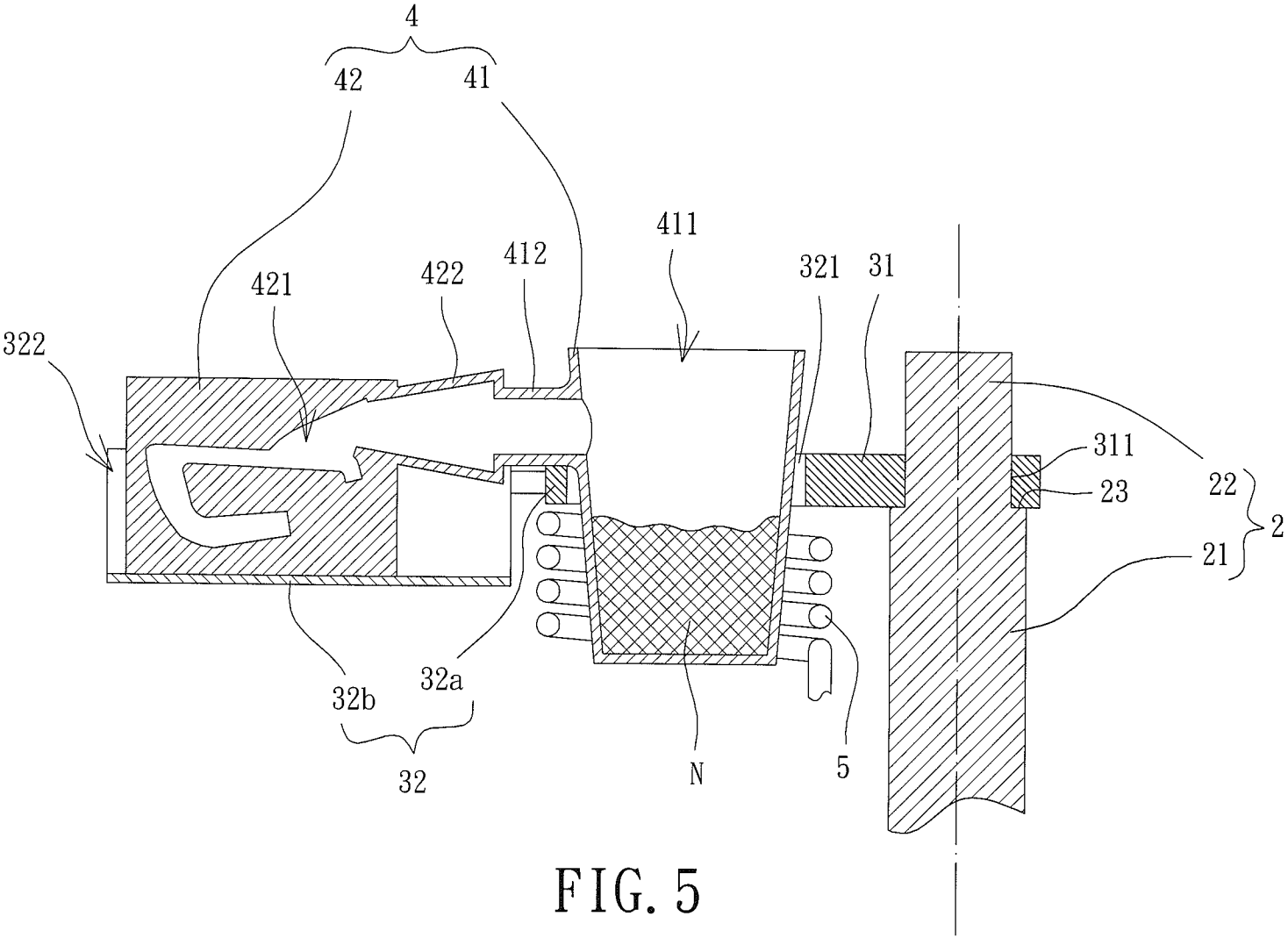
FIG. 5 is a view similar to FIG. 3, illustrating another step of the method according to the present invention.

With reference to FIGS. 1 and 5, the at least one metal ingot P is heated in a vacuum environment to melt into molten metal. Specifically, after the shell mold 4 is positioned, the heater 5 is lifted to the preset location surrounding the crucible portion 41, and the gas in the chamber 11 of the vacuum furnace 1 is drawn out via the gas guiding tube 12 to control the vacuum degree. After the vacuum degree reaches a preset value (such as smaller than 0.3 mbar), the heater 5 is activated to heat the crucible portion 41 of the shell mold 4 and, thus, melt the at least one metal ingot P in the crucible portion 41 into molten metal N. When the heater 5 operates, the frequency and the power of the power supply can be 4-30 kHz and 5-100 kW, respectively. After the at least one metal ingot P melts into molten metal N, the heater 5 is stopped and is rapidly moved downward to a location not surrounding the crucible portion 41.

Figure 6:
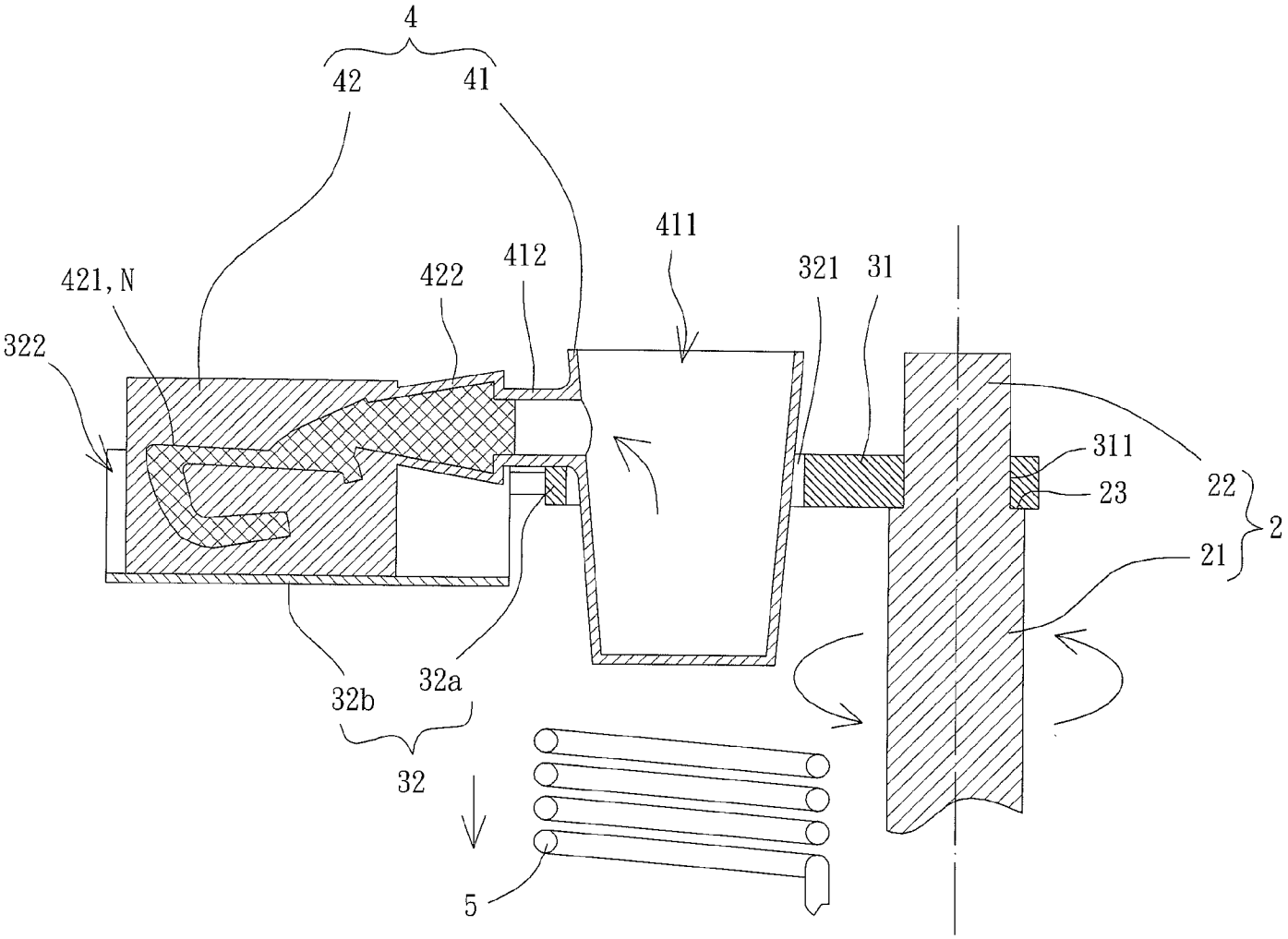
FIG. 6 is a view similar to FIG. 5, illustrating a further step of the method according to the present invention.

With reference to FIGS. 1 and 6, the rotating shaft 2 is driven to rotate the rotary table 3, causing the molten metal N to flow into the cavity portion 42 of the shell mold 4. Specifically, the rotating shaft 2 is driven by the motor M to rotate about the rotating axis at a speed of about 200-700 rpm. The rotating speed can be adjusted according to the thickness of the cast product (i.e., the volume of the cavity 421). When the rotary table 3 is actuated to rotate about the rotating axis, the molten metal N flows along the inner periphery of the crucible portion 41 of the shell mold 4 under the centrifugal force and passes through the first connecting tube 412 and the second connecting tube 422 of the shell mold 4 into the cavity portion 42 to proceed with pouring and, thus, to fill the cavity 421.

After pouring, the rotating shaft 2 is slowly stopped, and the shell mold 4 is removed from the rotary table 3. After the molten metal N cools and solidifies, the shell mold 4 is destroyed to obtain a casting having a cast product portion. The cast product portion is separated from the casting (such as by cutting the cast product portion from the casting with a cutter or by vibration to break the cast product portion from the casting) to obtain at least one golf iron head. Then, heat treatment is conducted on the at least one golf iron head to provide a striking faceplate of the at least one golf iron head with a tensile strength of 280-340 ksi and an elongation of 4%-20%. Furthermore, the minimum thickness (excluding the groove depth) of the striking faceplate of the at least one golf iron head is about 1.4-1.8 mm after withstanding 3000 cannon shots at a speed of 50 m/s, which is helpful in reducing the overall weight of the at least one golf iron head and in reducing the weight of the striking faceplate. The striking faceplate of the at least one golf iron club can be of a thickened or non-thickened structure.

Thus, the method for manufacturing a high-strength golf iron head with a thin striking faceplate according to the present invention can be produced in a nearly vacuum environment to reduce the chemical reaction of the cast material with air during smelting, such that the metal ingot P can easily and more evenly melt to avoid oxidative fire cracks resulting from reaction with air while the molten metal N is flowing from the crucible portion 41 of the shell mold 4 into the cavity portion 42. Thus, appearance defects, such as sesame dot defects and black bean defects, are less likely to be formed on the cast product of the golf iron head. Furthermore, casting defects of slag holes or blowholes formed by the reactive gas are less likely to be generated, increasing the tensile strength of the cast product of the golf iron head.

Furthermore, reduced chemical reaction between the molten metal N and air also increases the flowability of the molten metal N in the shell mold 4. Furthermore, the molten metal N is reliably poured into the cavity 421 of the shell mold 4 by using centrifugal force before the molten metal N re-solidifies, which not only avoids a waste of the cast material due to solidification of a portion of the molten metal N in the crucible portion 41 but assures that the cavity portion 42 can be filled with the molten metal N after the molten metal N has flown into the cavity portion 42. The yield of the cast products of the golf iron heads can be increased, and the possibility of formation of gaps in the cast products of the golf iron heads due to cold shut is reduced. Thus, the tensile strength of the cast products of the golf iron heads is increased.

Thus, the method according to the present invention can produce a high-strength golf iron head and, thus, allows thinning of the striking faceplate of the high-strength golf iron head, such that the high-strength golf iron head can have a thin striking faceplate with a minimum thickness of about 1.4-1.8 mm while possessing a high strength and an excellent elongation to increase the total number of hits the striking faceplate can withstand. As a result, the high-strength golf iron head not only has good hitting performances including a high restitution coefficient but has a prolonged service life.

Figure 7:
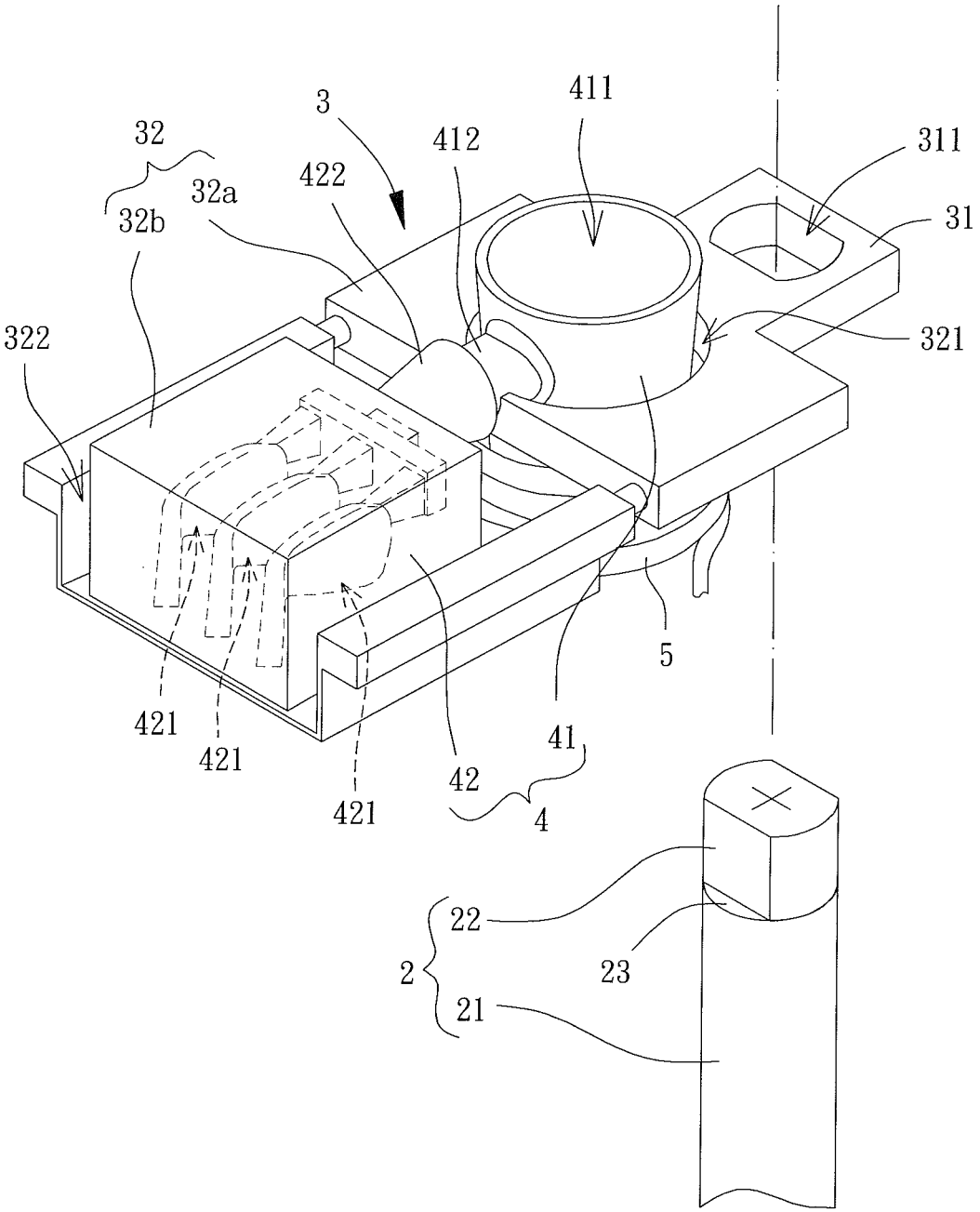
FIG. 7 is an exploded, perspective view of a portion of another vacuum centrifugal casting device capable of carrying out the method for manufacturing a high-strength golf iron head with a thin striking faceplate according to the present invention.

With reference to FIG. 7, in another embodiment, the method for manufacturing a high-strength golf iron head with a thin striking faceplate according to the present invention can be carried out by using a shell mold 4 having a plurality of cavities 421 to produce a plurality of high-strength golf iron head at a time, increasing the manufacturing efficiency.

In view of the foregoing, the method for manufacturing a high-strength golf iron head with a thin striking faceplate according to the present invention can reduce the chemical reaction of the cast material with air during smelting, increasing the tensile strength of the cast product and allowing thinning of the striking faceplate of the golf iron head. Furthermore, the method for manufacturing a high-strength golf iron head with a thin striking faceplate according to the present invention can increase the yield and the quality of the cast products.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A method for manufacturing a high-strength golf iron head with a thin striking faceplate comprising:

placing a shell mold onto a rotary table, with the shell mold including a crucible portion and a cavity portion in communication with the crucible portion with the rotary table coupled to a rotating shaft rotatable about a rotating axis;

placing at least one metal ingot into the crucible portion of the shell mold, and melting the at least one metal ingot into molten metal in a vacuum environment;

driving the rotating shaft to rotate the rotary table, causing the molten metal to pour into the cavity portion from the crucible portion of the shell mold;

slowly stopping the rotating shaft and removing the shell mold after the molten metal pours into the cavity portion;

destroying the shell mold after the molten metal cools and solidifies, obtaining a casting having a cast product portion;

separating the cast product portion from the casting to obtain at least one golf iron head; and heat treating the at least one golf iron head to provide a striking faceplate of the at least one golf iron head with a tensile strength of 280-340 ksi, an elongation of 4%-20%, and a minimum thickness of 1.4-1.8 mm excluding a groove depth of the striking faceplate, with placing the shell mold comprising forming the shell mold, with forming the shell mold including:

preparing a wax blank including a crucible blank and a casting blank, with the crucible blank including a first connecting portion on an outer periphery of the crucible blank, with the casting blank including a second connecting portion, with the first connecting portion and the second connecting portion integrally connected to each other;

forming an enveloping layer on an outer surface of the wax blank;

heating the wax blank and the enveloping layer to melt the wax blank out; and after heating the wax blank and the enveloping layer, sintering the enveloping layer at a high temperature to form the shell mold including the crucible portion and the cavity portion integral with the crucible portion.

2. The method for manufacturing the high-strength golf iron head with the thin striking faceplate as claimed in claim 1, with placing the at least one metal ingot comprising placing a metal ingot of a high-strength steel alloy, and with the metal ingot having a composition identical to a composition of the high-strength golf iron head to be produced.

3. The method for manufacturing the high-strength golf iron head with the thin striking faceplate as claimed in claim 1, with placing the at least one metal ingot comprising placing a plurality of metal ingots, with a composition of the molten metal of the plurality of metal ingots being identical to a composition of the high-strength golf iron head to be produced.

4. The method for manufacturing the high-strength golf iron head with the thin striking faceplate as claimed in claim 1, wherein placing the shell mold comprises placing the shell mold including a surface layer of a fire-resistant material including zirconium silicate, yttrium oxide, stabilized zirconium oxide, or aluminum oxide.

5. The method for manufacturing the high-strength golf iron head with the thin striking faceplate as claimed in claim 1, wherein placing the shell mold comprises placing the shell mold including a back layer of a material including a mullite compound containing 45-60 wt % of aluminum oxide and 55-40 wt % of silicon oxide.

6. The method for manufacturing the high-strength golf iron head with the thin striking faceplate as claimed in claim 1, wherein placing the shell mold comprises placing the shell mold including a back layer of a material including a silicon oxide compound containing more than 95% of silicon oxide.

7. A method for manufacturing a high-strength golf iron head with a thin striking faceplate, comprising:

providing a shell mold including a crucible portion and a cavity portion in communication with the crucible portion;

placing the shell mold onto a rotary table with a heater surrounding the crucible portion, with the rotary table coupled to a rotating shaft rotatable about a rotating axis;

placing at least one metal ingot into the crucible portion of the shell mold, and melting the at least one metal ingot into molten metal in a vacuum environment, with melting the at least one metal ingot comprising activating the heater to heat the crucible portion and moving the heater to a location surrounding the crucible portion when the heater is activated to heat the crucible portion;

driving the rotating shaft to rotate the rotary table, causing the molten metal to pour into the cavity portion from the crucible portion of the shell mold;

slowly stopping the rotating shaft and removing the shell mold after the molten metal pours into the cavity portion;

destroying the shell mold after the molten metal cools and solidifies, obtaining a casting having a cast product portion;

separating the cast product portion from the casting to obtain at least one golf iron head; and heat treating the at least one golf iron head to provide a striking faceplate of the at least one golf iron head with a tensile strength of 280-340 ksi, an elongation of 4%-20%, and a minimum thickness of 1.4-1.8 mm excluding a groove depth of the striking faceplate; and moving the heater to a position not surrounding the crucible portion when driving the rotating shaft.

8. The method for manufacturing the high-strength golf iron head with the thin striking faceplate as claimed in claim 7, with placing the at least one metal ingot comprising placing a metal ingot of a high-strength steel alloy, and with the metal ingot having a composition identical to a composition of the high-strength golf iron head to be produced.

9. The method for manufacturing the high-strength golf iron head with the thin striking faceplate as claimed in claim 7, with placing the at least one metal ingot comprising placing a plurality of metal ingots, with a composition of the molten metal of the plurality of metal ingots being identical to a composition of the high-strength golf iron head to be produced.

10. The method for manufacturing the high-strength golf iron head with the thin striking faceplate as claimed in claim 7, wherein placing the shell mold comprises placing the shell mold including a surface layer of a fire-resistant material including zirconium silicate, yttrium oxide, stabilized zirconium oxide, or aluminum oxide.

11. The method for manufacturing the high-strength golf iron head with the thin striking faceplate as claimed in claim 7, wherein placing the shell mold comprises placing the shell mold including a back layer of a material including a mullite compound containing 45-60 wt % of aluminum oxide and 55-40 wt % of silicon oxide.

12. The method for manufacturing the high-strength golf iron head with the thin striking faceplate as claimed in claim 7, wherein placing the shell mold comprises placing the shell mold including a back layer of a material including a silicon oxide compound containing more than 95% of silicon oxide.

* * * * *